US005499425A

United States Patent [19]

Glenn, III

[11] Patent Number: 5,499,425

[45] Date of Patent: Mar. 19, 1996

[54] HEIGHT ADJUSTMENT MECHANISM FOR AN UPRIGHT VACUUM CLEANER

[75] Inventor: William K. Glenn, III, Anderson, S.C.

[73] Assignee: Ryobi Motor Products, Easley, S.C.

[21] Appl. No.: 360,252

[22] Filed: Dec. 20, 1994

[51] Int. Cl.[6] ..... A47L 5/34

[52] U.S. Cl. ..... 15/354; 15/339

[58] Field of Search ..... 15/354, 355, 356, 15/368, 373, 339

[56] References Cited

U.S. PATENT DOCUMENTS

| | | | |
|---|---|---|---|
| 3,683,448 | 8/1972 | Lagerstrom et al. | 15/354 |
| 3,821,831 | 7/1974 | Grover | 15/373 X |
| 4,437,205 | 3/1984 | Koland | 15/354 |
| 5,042,109 | 8/1991 | Stephens | 15/354 |
| 5,134,750 | 8/1992 | King et al. . | |
| 5,222,276 | 6/1993 | Glenn, II . | |
| 5,269,042 | 12/1993 | Stephens et al. . | |

*Primary Examiner*—Chris K. Moore

*Attorney, Agent, or Firm*—Brooks & Kushman

[57] ABSTRACT

A vacuum cleaner and a method for constructing a vacuum cleaner is disclosed. The vacuum cleaner utilizes interchangeable detent bars having different numbers of detents thereon to selectively determine the number of height adjustment selections the vacuum cleaner will have. The vacuum cleaner includes a chassis, a detent bar attached to the chassis, a cam member slidably mounted to the chassis and a wheel retainer with laterally spaced wheels thereon. The wheel retainer is pivotally mounted to chassis such that the wheels may pivot toward and away from the chassis. The wheel retainer has a cam follower surface thereon which operatively cooperates with a cam surface on the cam member to raise and lower the wheels relative to the chassis as the cam member is moved. The cam member has a finger selectively engageable with individual detents on the detent bar to selectively laterally position the cam member relative to the chassis and thereby selectively establish the height of the chassis from a floor surface. The number of selectable height positions that the vacuum cleaner has is determined by the number of detents of the particular detent bar chosen to be installed on the chassis.

6 Claims, 4 Drawing Sheets

HEIGHT ADJUSTMENT MECHANISM FOR AN UPRIGHT VACUUM CLEANER

INCORPORATION BY REFERENCE

This application hereby incorporates by reference U.S. Pat. No. 5,222,276 to Glenn III, entitled Vacuum Cleaner For On Floor and Off Floor Suction Cleaning.

TECHNICAL FIELD

This invention relates to height adjustment mechanisms for floor nozzles or head assemblies of upright vacuum cleaners.

BACKGROUND OF THE INVENTION

Upright vacuum cleaners are generally provided with a height adjustment mechanism for varying the height of a chassis of a head assembly relative to a floor surface. The chassis carries a motor and fan and an agitator brush for brushing a floor surface to be cleaned. The distance the chassis and agitator brush are raised above a floor surface is dependent upon the type of floor surface to be cleaned. For example, if a linoleum or vinyl floor is being vacuumed, the agitator brush is spaced closely to the floor. In contrast, if a very deep pile carpet is being cleaned, the agitator brush is raised away from the floor surface to keep the agitator brush from binding with the individual strands of the carpet.

One popular technique of adjusting the relative height a chassis and agitator brush of a vacuum cleaner relative to a floor surface is to provide a movable variable height cam member intermediate the chassis and an axle or wheel retainer supporting front wheels. An example of a vacuum cleaner employing such a height adjustment mechanism is described U.S. Pat. No. 5,222,276, which has been incorporated herein by reference.

In that patent, a cam member has a pair of transversely spaced cam surfaces each having a series of varying height arcuate stepped cam surfaces. The stepped cam surfaces cooperate with a respective pair of cam followers formed on an axle retainer member supporting an axle and front wheels. The axle retainer member is pivotally attached to a chassis to rotate relative thereto about a transversely extending pivot axis. The pivoting of the axle retainer member and axle about the pivot axis will raise and lower the wheels relative to the chassis with the chassis, in turn, pivoting about a pair of back wheels. A knob is used to manually move the cam member from side to side. This causes different stepped cam surfaces to selectively engage the cam followers. Consequently, the axle retainer member pivots raising and lower the front wheels to one of a plurality of selected heights which is dependent upon the height of the individual stepped cam surfaces cooperating with the cam followers.

Inexpensive models of vacuum cleaners often provide only two or three different height adjustment settings of the chassis and agitator brush relative to a floor surface. More expensive or deluxe models, partially due to the need for product differentiation, generally provide for a greater number of height adjustment selections. Accordingly, different tooling and molds are required for the different height adjusting mechanisms of the different vacuum cleaners. This can result in significant tooling costs for creating a line of vacuum cleaners which have different numbers of height selection positions, particularly, if a series of complex molds need to be made for each model in the line of vacuum cleaners.

The present invention is intended to meet the need for providing height adjustment mechanisms for vacuum cleaners which provide for a wide selection of the number of possible height adjustment settings for different models at a low cost.

SUMMARY OF THE INVENTION

A vacuum cleaner comprising a chassis, a discrete detent rack, a wheel retainer member and wheels, and a cam member is disclosed. The chassis supports a motor and a fan. The discrete detent rack is attached to the chassis and has a plurality of detents formed thereon. The wheel retainer member is pivotally attached to the chassis to pivot about a transversely extending pivot axis. The wheel retainer member supports a pair of laterally spaced apart wheels and has at least one cam follower surface thereon, and preferably two.

The cam member is movably mounted relative to the chassis and has a variable height cam surface thereon for operatively engaging the cam follower surface of the wheel retainer member. The cam member has a positioning finger thereon for engaging one of the plurality of detents to selectively laterally position the cam surface relative to the cam follower surface thereby adjusting the distance between the wheels and the chassis. A handle may be provided which attaches to the cam member for manually moving the cam member relative to the chassis thereby raising and lowering the wheels relative to the chassis.

This design allows detent bars with different numbers of detents thereon, or with differently spaced detents, to be interchangeably attached to a standard chassis to construct vacuum cleaners with different numbers of height adjustment settings or positions.

Preferably, the cam surface has a pair of laterally spaced linear ramp portions and the wheel retainer member has a pair of laterally spaced cam follower surfaces which respectively cooperate with the linear ramp portions.

The present invention also includes a method for making a vacuum cleaner wherein the vacuum cleaner can be constructed with different predetermined number of height adjustment settings. The method comprises the following steps. A chassis is provided. A motor and fan is attached to the chassis. A detent bar having a predetermined number of detents is selected from a plurality of detent bars having different numbers of detents thereon. The detent bar is attached to the chassis. A cam member is movably mounted to the chassis and has a cam surface of varying height thereon. The cam member also has a finger for selectively engaging one of the plurality of detents to selectively position the cam member relative to the wheel retainer member.

The wheel retainer member is pivotally attached to the chassis. The wheel retainer member has a cam follower surface thereon which cooperates with the cam surface of the cam member to adjust the distance between the wheels and the chassis dependent upon which of the detents the finger is selectively engaged.

This method allows the number of selectable height adjustment positions the vacuum cleaner possesses to be controlled by selecting an appropriate detent bar having a desired number of detents.

It is an object of the present invention to provide a height adjustment mechanism for a vacuum cleaner which utilizes interchangeable detent bars having different predetermined numbers of detents thereon corresponding to the desired number of height adjustment selections.

It is another object to provide a vacuum cleaner which has a height adjustment mechanism which utilizes interchangeable detent bars to change the number of height adjustment positions that the vacuum cleaner may have.

An advantage the present invention has over other adjustable height vacuum cleaners is that standard molded parts made from costly, complex molds, such as a chassis, a cam member and a wheel retainer, can be used with interchangeable detent bars made from relative inexpensive molds to thereby provide vacuum cleaners with a wide range of selectable number of height adjustment positions at a low cost.

BRIEF DESCRIPTION OF THE DRAWINGS

These and other features, objects and advantages of the present invention will become readily apparent from the following description, pending claims, and accompanying sheet of drawings where:

BEST MODE FOR CARRYING OUT THE INVENTION

Figure 1:
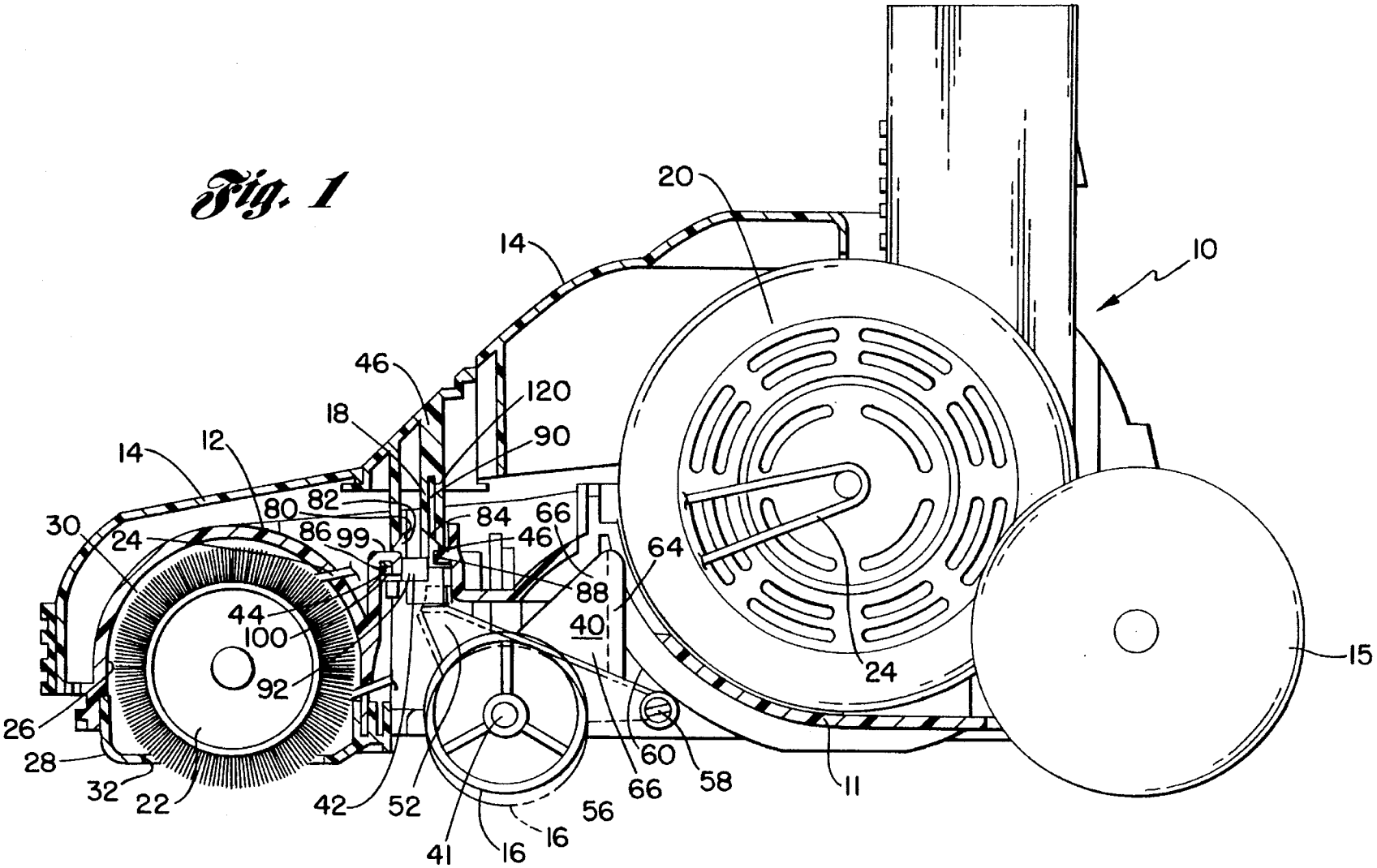
FIG. 1 is a side sectional view of a head assembly of a vacuum cleaner utilizing an interchangeable detent bar made in accordance with the present invention.

FIG. 1 shows an upright vacuum cleaner 10 with a head assembly 11 shown partially in cut-away. Vacuum cleaner 10 has a chassis 12 and an overlying hood 14 which releasably snaps thereon. Ideally both chassis 12 and hood 14 are made of injection molded plastic. Rear wheels 15 (one of which is shown) is mounted on the rear of chassis 12. A pair of transversely or laterally spaced front wheels 16 are supported on chassis 12 by a height adjustment mechanism 18 as will be described later.

A motor/fan assembly 20 is mounted in a pair of journals formed in chassis 12. An agitator brush 22 is supported on bearings within chassis 12. A pulley belt 24 extends between motor/fan assembly 20 and agitator brush 22 to rotatably drive agitator brush 22.

A laterally extending, generally semi-cylindrical cavity 26 is defined in the front portion of chassis 12. A lower cover plate 28 cooperates with chassis 12 to form an agitator brush chamber 30 in which agitator brush 22 is disposed. A lower opening 32 provides access for the bristles of agitator brush 22 to extend out of brush chamber 30. Although not shown, lower cover plate 28 cooperates with chassis 12 to form a longitudinally extending belt chamber and a longitudinally extending air passageway from brush chamber 30 to motor/fan assembly 20.

As indicated in FIG. 1, front wheels 16 are selectably positionable between a retracted position as shown in full line and an extended position shown in dashed line. In fact, front wheels 16 may be positioned at a number of selected heights relative to chassis 12 due to the operation of height adjustment mechanism 18.

Figure 2:
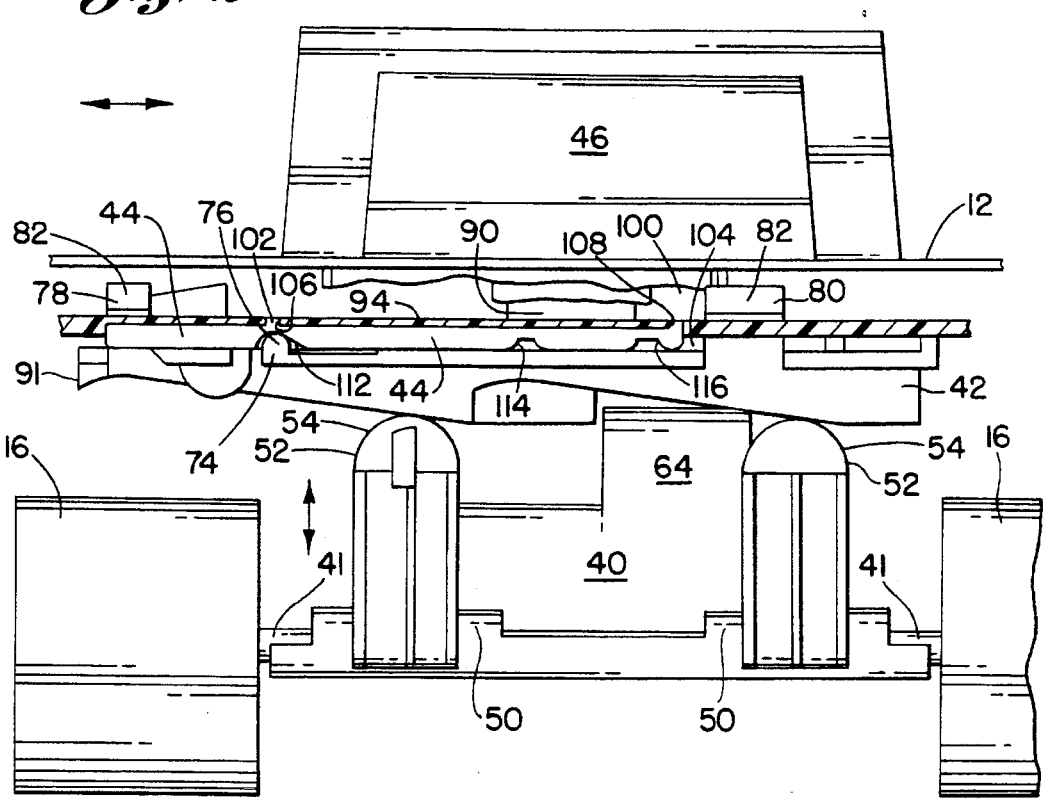
FIG. 2 is a fragmentary front sectional view of the vacuum cleaner with wheels in an extended position.
Figure 3:
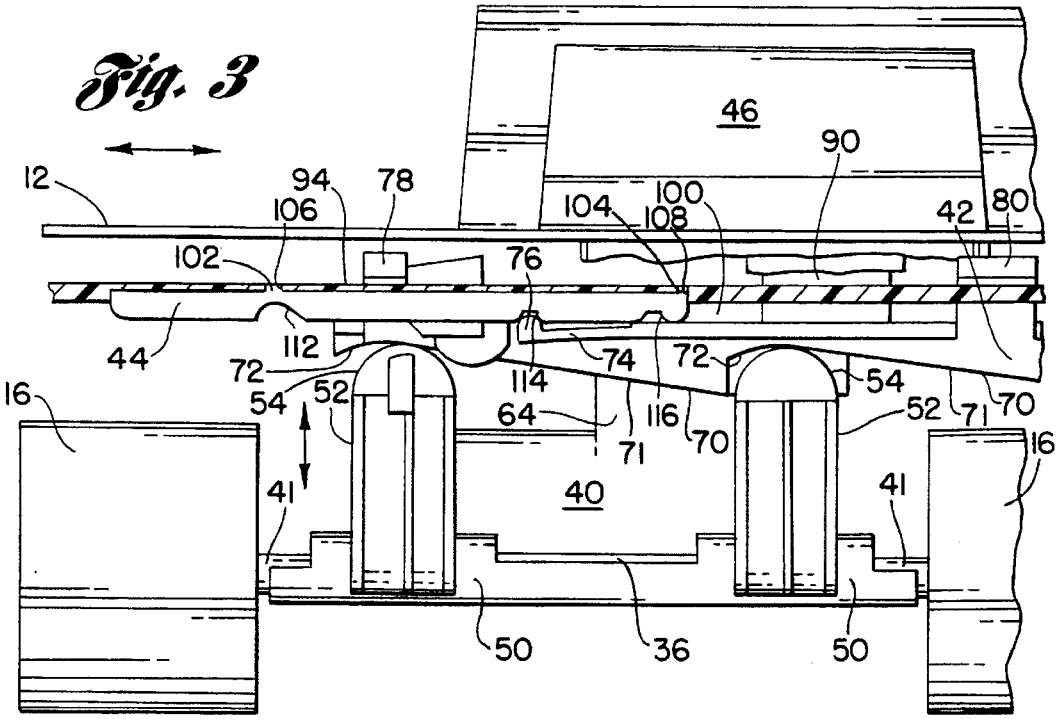
FIG. 3 is view similar to FIG. 2 with the wheels in a retracted position.
Figure 4:
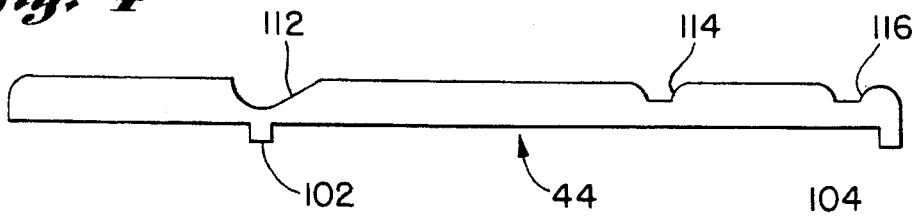
FIGS. 4–8 show a plurality of interchangeable detent bars having different numbers of positioning detents located along the length of the bar.
Figure 5:
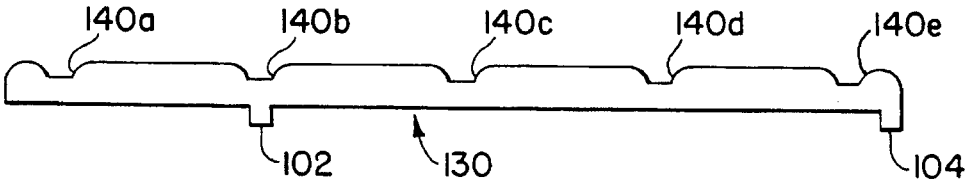
Figure 6:
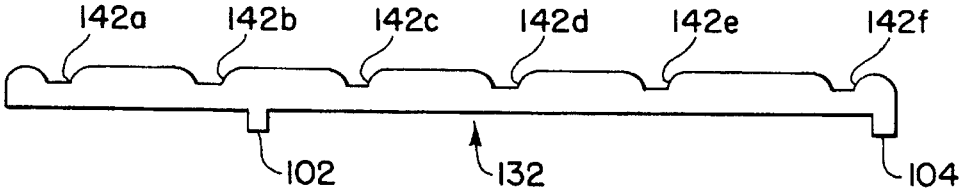
Figure 7:
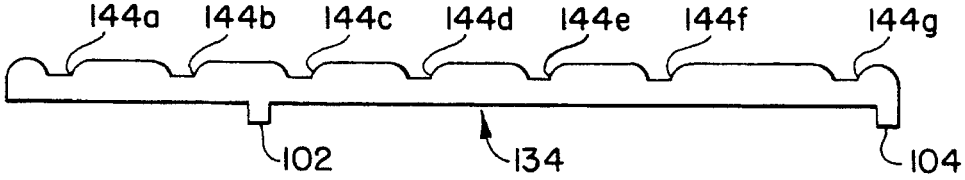
Figure 8:
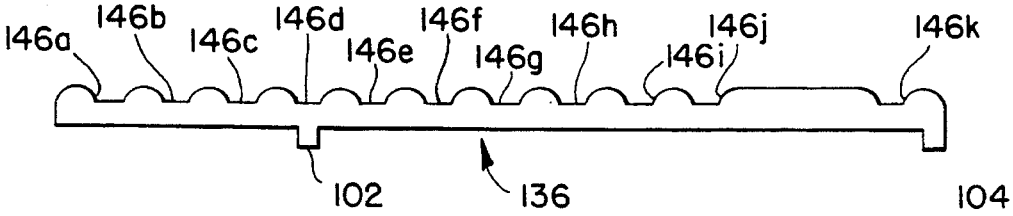
Figure 9:
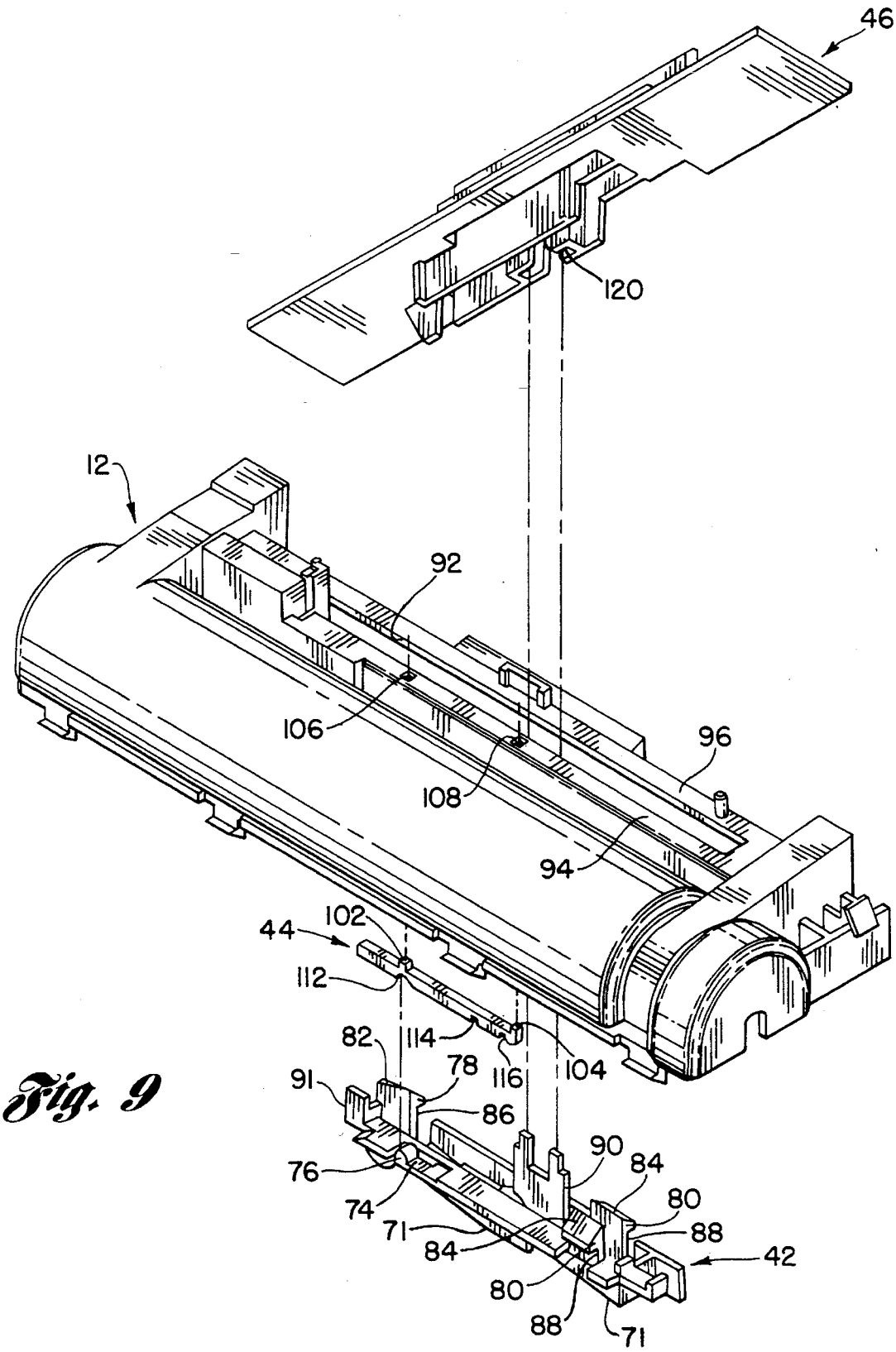
FIG. 9 is an exploded perspective view of a handle, a fragmentary portion of the chassis, a detent bar and a cam member.

Turning now to FIGS. 2 and 3, height adjustment mechanism 18 includes a laterally extending wheel retainer 40 including an axle 41, a cam member 42, a detent bar 44, and a handle 46. Ideally, wheel retainer 40, cam member 42 and handle 46 are injection molded parts. FIG. 9 shows a perspective view of handle 46, a portion of chassis 12, detent bar 44 and cam member 42. FIG. 2 shows front wheels 16 extended away from chassis 12, thereby placing agitator brush 22 in a raised position relative to a floor surface. FIG. 3 shows wheels 16 retracted relative to chassis 12, thereby placing agitator brush 22 in a lowered position relative to front wheels 16 and a floor surface. This retracted position is ideal for cleaning linoleum or very short pile carpeting. In the extended position of FIG. 2, vacuum cleaner 10 ideally is used to clean deep pile carpet, such as shag carpet.

Wheel retainer 40 includes a pair of laterally spaced hub portions 50 through which axle 41 passes. Extending vertically upward from hub portions 50 are a pair of legs 52, which terminate in cam follower surfaces 54. Referring back to FIG. 1, extending rearwardly from and intermediate hub portions 50 is a base plate 56 which has an integrally formed axle 58 at the rear end portion thereof. A pair of laterally spaced forks 60, one of which is shown on chassis 12, rotatably support axle 58 to pivot about a pivot axis extending coaxial with axle 58. Wheel retainer 40, which supports axle 41 and front wheels 16, therefore moves in an arcuate path about the pivot axis. While preferably axle 41 is a separate metal axle supported by wheel retainer 40, it is also possible that such an axle could be integrally formed on wheel retainer 40, similar to axle 58. A vertical wall 64 extends vertically upward from base plate 56 and is supported by a web 66.

Returning to FIG. 3, cam member 42 has a pair of laterally spaced cam surfaces 70 formed on its lower side which include linear ramp portions 71 terminating in arcuate portions 72. Cam follower surfaces 54 on legs 52 of wheel retainer 40 abuttingly engage cam surfaces 70. As cam follower surfaces 54 slide up and down cam surfaces 70, wheel retainer 40 pivot about axle 58 and wheels 16 retract and extend relative to chassis 12.

As best seen in FIG. 9, integrally formed on the top of cam member 42 is a cantilevered finger 74 with a retaining tab 76 formed at an end thereof. Laterally spaced mounting clips 78 and 80 are formed on cam member 42 and extend upwardly. Clips 78 and 80 are used to slidingly mount cam member 42 to chassis 12. Clip 78 has a single prong 82 and clip 80 has a pair of opposing prongs 84 with respective outboard extending L-shaped mounting surfaces 86 and 88 located on the underside of the prongs. Located between clips 78 and 80 is an upwardly extending lug member 90.

Cam member 42 has a distal end 91 which can be used to abut and close a spring biased open conversion door (not shown) to shut off air flow through the passageway extending from brush chamber 30 to the motor/fan assembly 20. Such doors are well known to effect conversion of an upright vacuum cleaner between on floor and off floor cleaning modes. As this invention is directed to a particular height adjustment mechanism for a vacuum cleaner, further details regarding the operation of the conversion door will not be described.

Referring again to FIG. 1, chassis 12 has an elongate slot 92 which extends laterally and in which cam member 42 slidably mounts. Horizontal bearing surfaces 94 and 96 are adjacent slot 92. The L-shaped mounting surfaces 86 and 88 of clips 78 and 80 are mounted and slide upon mounting surfaces 94 and 96. Prongs 82 and 84 are resilient and may be squeezed together to allow their insertion through slot 92 and then released with mounting surfaces 86 and 88 residing upon bearing surfaces 94 and 96 of chassis 12.

An inverted channel 100 is formed in chassis 12 forwardly of and extends parallel with elongate slot 92. Detent bar 44 is held within this channel 100.

Detent bar 44 is an elongate member with upwardly extending retaining bosses 102 and 104, as seen in FIGS. 1–2 and 10. Retaining bosses 102 and 104 are pressed into openings 106 and 108 formed beneath mounting surface 94 of chassis 12. Formed on the underside of detent bar 44 are a plurality of spaced apart detent 112, 114 and 116. Detents 112, 114 and 116 are sized to receive retaining tab 76 of cam member 42 thereby positioning and holding cam member 42 relative to chassis 12 at selected lateral positions. This results in cam follower surfaces 54 engaging cam surfaces 70 at particular lateral positions and locating wheel retainer 40 and wheels 16 at selected distances or heights from chassis 12.

Handle 46 has a pocket 120 formed on the underside thereof sized to receive lug member 90 of cam member 42. Accordingly, the laterally translation of handle 46 relative to chassis 12 will move cam member 42 laterally as well. This lateral movement will cause wheel retainer 40 to rise and fall relative to chassis 12 as cam follower surfaces 54 engage the varying height linear ramps portions 71 of cam surfaces 70. Handle 46 is aesthetically designed to blend in with the contours of hood 14 covering chassis 12.

FIGS. 5–8 show different embodiments of detent bars 44, 130, 132, 134 and 136. Detent bars 44, 130, 132, 134 and 136 are generally identical with the exception of the number of detents located therein. Accordingly, identical structure such as retaining bosses 102 and 104 are identically identified in the detent bars of FIGS. 4–8. Detent bars 130, 132, 134 and 136, respectively, have detents 140*a–e*, 142*a–f*, 144*a–g*, and 146*a–k*.

When a vacuum cleaner, such as vacuum cleaner 10, is being assembled, a determination is made as to the number of height adjustment selections needed. The greater the number of detents on a detent bar the greater the number of height adjustment selections available. This increases the height adjustment sensitivity of the vacuum cleaner. An appropriate detent bar is chosen and retaining bosses 102 and 104 are installed in openings 106 and 108 of chassis 12.

Next, prongs 82 and 84 of cam member 42 are squeezed together and inserted into elongate slot 92 of chassis 12. Mounting surfaces 86 and 88 of prongs 82 and 84 slidably bear upon bearing surfaces 94 and 96 of chassis 12 allowing for relative lateral movement between cam member 42 and chassis 12. Concurrently, lug member 90 is also passed through slot 92. Handle 46 is placed over cam member 42 with lug member 90 being received within pocket 120.

Wheel retainer 40 with axle 41 and wheels 16 is then attached to chassis 12. Axle 58 is snapped into sockets 62 thereby pivotally attaching wheel retainer 40 to chassis 12.

The present invention using interchangeable detent bars, mountable within a single chassis, therefore affords great design flexibility at a low cost as the molds for the detent bar are generally quite inexpensive. Only single molds for each of chassis 12, cam member 42, and wheel retainer 40 are needed.

While the foregoing specification of this invention has been described in relation to a certain preferred embodiment thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A vacuum cleaner comprising:

a chassis supporting a motor and a fan;

an interchangeable detent bar attached to the chassis having a plurality of detents;

a wheel retainer pivotally attached to the chassis to pivot about a laterally extending pivot axis, the wheel retainer supporting a pair of laterally spaced apart wheels and having at least one upwardly extending strut with a cam follower surface thereon;

a cam member movably mounted to the chassis and having a variable height cam surface thereon for engaging the cam follower surface of the wheel retainer, the cam member having a positioning finger thereon for selectively engaging the plurality of detents to selectively laterally position the cam surface relative to the cam follower surface thereby adjusting the distance between the wheels and the chassis; and a handle attached to the cam member for moving the cam member relative to the chassis thereby raising and lowering the wheels relative to the chassis;

wherein the interchangeable detent bar may be replaced with another detent bar having a different number of detents thereon so that the number of height adjustment settings may be altered.

2. The vacuum cleaner of claim 1 wherein:

the cam surface includes a linear ramp portion.

3. The vacuum cleaner of claim 1 wherein:

the cam surface includes two laterally spaced apart linear ramp portions and the wheel retainer includes a pair of laterally spaced apart cam follower surfaces which cooperate the respective linear surfaces to adjust the distance between the wheels and the chassis.

4. The vacuum cleaner of claim 1 wherein:

the cam member includes a main body and the finger is cantilevered from the main body.

5. The vacuum cleaner of claim 1 wherein:

the handle is integrally formed with the cam member.

6. A method for making a vacuum cleaner comprising:

providing a chassis;

attaching a motor and fan to the chassis;

selecting a detent bar having a predetermined number of detents thereon from a plurality of detent bars having different predetermined numbers of detents;

attaching the selected detent bar to the chassis;

movably mounting a cam member to the chassis, the cam member having a cam surface of varying height thereon and a finger for selectively engaging the predetermined number of detent; and pivotally attaching a wheel retainer and wheels to the chassis, the wheel retainer having a cam follower surface thereon which cooperates with the cam surface to adjust the distance between the wheels and the chassis dependent upon which one of the detents the finger engages;

whereby the number of height adjustment positions the vacuum cleaner possesses is controlled by which one of the plurality of detent bars is selected to be attached to the chassis.

* * * * *